US008183482B2

(12) United States Patent
Martin et al.

(10) Patent No.: US 8,183,482 B2
(45) Date of Patent: May 22, 2012

(54) ROTARY SWITCH FOR A GLASS CERAMIC COOKTOP

(75) Inventors: Bernd Martin, St. Georgen (DE); Markus Schlegel, Bretten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 462 days.

(21) Appl. No.: 12/284,582

(22) Filed: Sep. 22, 2008

(65) Prior Publication Data

US 2009/0077822 A1 Mar. 26, 2009

(30) Foreign Application Priority Data

Sep. 24, 2007 (DE) ..... 10 2007 045 538

(51) Int. Cl.
*H01H 9/04* (2006.01)

(52) U.S. Cl. ..... 200/296; 200/336

(58) Field of Classification Search ..... 200/296, 200/336, 564–572; 307/122
See application file for complete search history.

(56) References Cited

U.S. PATENT DOCUMENTS

| | | | | |
|---|---|---|---|---|
| 2,832,851 | A * | 4/1958 | Jones | 200/6 R |
| 4,465,228 | A * | 8/1984 | Mori et al. | 236/20 A |
| 6,057,517 | A * | 5/2000 | Meyer | 200/5 A |
| 6,111,240 | A * | 8/2000 | Kishimoto et al. | 219/720 |
| 6,180,895 | B1 * | 1/2001 | Hutchinson et al. | 200/5 A |
| 6,838,785 | B2 * | 1/2005 | Schilling | 307/104 |
| 6,900,406 | B2 * | 5/2005 | Huber | 200/566 |
| 2007/0181410 | A1 * | 8/2007 | Baier | 200/17 R |
| 2010/0044203 | A1 * | 2/2010 | Matsumoto et al. | 200/5 A |

* cited by examiner

*Primary Examiner* — Lincoln Donovan
*Assistant Examiner* — Lisa Homza
(74) *Attorney, Agent, or Firm* — James E. Howard; Andre Pallapies

(57) ABSTRACT

The invention relates to a rotary switch for a glass ceramic cooktop, which rotary switch includes a rotary knob projecting above the glass ceramic plate. The rotary knob interacting with a switch unit disposed on an underside of the glass ceramic plate. The rotary knob interacts with the switch unit via a knob axis and the switch unit includes a signal generator for generating a signal on the based on an angular position of the knob axis.

25 Claims, 6 Drawing Sheets

ROTARY SWITCH FOR A GLASS CERAMIC COOKTOP

BACKGROUND OF THE INVENTION

The invention relates to a rotary switch for a glass ceramic cooktop.

In household appliances, control elements which may be embodied as rotary switches, sliding switches or as electronic switches, touch-sensitive (contact) switches for example, are well-known for the purpose of activating or setting functions. The use of rotary switches is preferred owing to their good operability. In the case of household appliances which constitute a glass ceramic cooktop, which is also referred to as a glass ceramic stovetop, the use of rotary switches has, however, been possible only to a limited extent hitherto.

In DE 20 2005 019 978 U1, for example, a control device is described which can represent a rotary switch, for example. In this case, in one embodiment, one part of the rotary switch, which represents a rotary control, is provided on the top of the glass ceramic plate and interacts contactlessly with sensor elements which are disposed on the underside of the glass ceramic plate such that control signals are transmitted to a controller that is disposed underneath the plate. In a further embodiment, the rotary control disposed on the glass ceramic plate is connected via a control device axis or, as the case may be, rotational axis to a control device which represents an energy controller. In this arrangement the rotational axis projects through an opening in the plate. Also provided on the control device, in particular on the rotary control, are contact sensors via which further functions of the appliance actuated by means of the control device can be activated. For example, the contact sensors can be used for switching a hotplate on and off. In the embodiment in which the rotary control is connected to the control device via a rotational axis, the signals of the contact sensors are transmitted along the rotational axis.

A disadvantage of this known control device is that in the case of the embodiment in which no opening is provided, the signal for controlling the hotplate can only be transmitted by magnetic or optical means. As a result, a relatively complex and expensive design is required and the detection function can easily be affected by accumulated dirt or other external influences. Conversely, in the case of the embodiment in which the rotary position of the rotary knob is transmitted via a rotational axis, i.e. mechanically, the rotary position is available solely as an input for the control device. In the last-mentioned embodiment, therefore, the rotary position cannot be used for other purposes.

BRIEF SUMMARY OF THE INVENTION

The object of the present invention is therefore to provide a rotary switch for a glass ceramic cooktop which has a simple design and can be used in a variety of ways.

This object is achieved according to the invention by means of a rotary switch for a glass ceramic cooktop, said rotary switch comprising a rotary knob which projects beyond the glass ceramic plate and interacts with a switch unit that is disposed on the underside of the glass ceramic plate. The rotary switch is characterized in that the rotary knob interacts with the switch unit via a knob axis and the switch unit comprises at least one signal generation unit for generating an electrically processible information signal on the basis of the angular position of the knob axis.

As a result of the interaction of the rotary knob with the switch unit disposed on the underside of the glass ceramic plate, the rotary movement of the rotary knob is transmitted via mechanical means to the switch unit for further processing and is consequently less sensitive to accumulations of dirt and other environmental conditions such as high temperatures, for example. Since a signal generation unit is also provided on the underside of the glass ceramic plate, the current angular position, i.e. the degree of rotation of the rotary knob, can be used for control, regulating and other functions. Accordingly, a plurality of functions can be executed by way of the degree of rotation of the rotary knob. Moreover, owing to the arrangement of the signal generation unit underneath the glass ceramic plate, the generated signals can be easily forwarded, via a board for example, and also used at other points of the cooktop or stovetop.

According to a preferred embodiment, the switch unit comprises at least one switch component, in particular a power switch, which is actuated by means of the signal generation unit. The switch component can be a mechanical switch or an electrical switch. As the power switch is actuated by the signal generation unit it is possible to make control of the power output of the cooktop dependent on the angular position. As a result, for example, a separate, central power voltage circuit by means of which the operation of the hotplate can be activated, in particular a main switch relay on the electronics board of the glass ceramic cooktop, which is necessary in the case of traditional appliances, can be dispensed with. Particularly preferably the power switch is connected by means of mechanical or electrical contacts on the signal generation unit. This means that the power switch is actuated independently of the signal generated by the signal generation unit, thereby increasing the operational safety of the glass ceramic cooktop.

According to the invention, the signal generation unit and the power switch are preferably disposed adjacent to each other. In particular, the signal generation unit is arranged around the rotational axis of the rotary knob and the power switch is radially adjacent to the signal generation unit. Owing to this arrangement of the signal generation unit and the switch, the overall installation height of the switch unit is minimized. As a result of this, the installation height corresponds to the height that is available in a glass ceramic stovetop, which means that no structural modifications to the stovetop need to be provided in order to be able to use the rotary switch according to the invention. Furthermore, the rotary switch can be arranged at different positions of the stovetop or cooktop, for example in immediate proximity to the hotplate requiring to be controlled in each case.

According to one embodiment, the signal generation unit generates a signal voltage as a function of the angular position of the rotary knob. Since the signal is present as a signal voltage, it is immediately available for further processing. Thus, the signal voltage can be routed for example to a display element or to a control element and be used there directly as an input variable.

The signal generation unit preferably has a rotary disk. A rotary disk, within the meaning of the invention, designates a disk which, when the knob axis or, as the case may be, rotary shaft is rotated, is rotated through the same angle. The rotary disk is preferably removably connected to the knob axis and has a greater outer diameter than the knob axis. Owing to the greater diameter, the top and/or underside of the rotary disk can on the one hand be made available for information transfer purposes. On the other hand, switching or actuation of a switch component that is radially spaced at a distance from the knob axis is possible by means of the rotary disk.

In order to generate a voltage signal, the rotary disk can be used for example with a comb for mechanically transmitting the angular position to a board of the switch unit. In this case the rotary disk represents a contact disk. In this embodiment the signal generation unit can be for example what is termed a Gray-code unit. However, other signal generation units are also possible. For example, the signal generation unit can represent an optical unit. In this case the angular position of the rotary knob can be determined via optical elements on the rotary disk. The advantage of using a rotary disk in the signal generation unit is that the circumference of the rotary disk can be used for other purposes, in particular for switching a radially adjacent switch in the switch unit. The switch component or switch can be switched mechanically or electrically.

In a preferred embodiment, at least one switch element for switching the power switch is provided on the circumference of the rotary disk. Said switch element can represent a switch contact or a mechanical resistance. A switch of the switch unit can easily be actuated by means of said switch elements. Furthermore, mechanical resistances can be used for example to generate a latching haptic which delivers feedback on the actuation of the rotary knob to the user. A precise definition of a torque of the rotary knob can also be realized via the switch elements.

The switch unit is preferably connected to a display unit. It is particularly preferred if the output of the signal generation unit serves as an input for the display unit. This enables the signal generated on the basis of the angular position of the rotary knob to be output on a display. This can be effected for example by means of a seven-segment display by means of which the selected power stage of the cooktop can be displayed. The switch unit and in particular the signal generation unit or a board of the switch unit are preferably connected via a signal cable to the display unit, in particular to a display board on which display elements are provided.

According to a preferred embodiment, the switch unit is connected to the rotary knob via a mounting unit. In this arrangement the mounting unit is removably connected to the switch unit. As a result of providing a separate mounting unit it can be ensured, on account of the decoupling, that the switch unit is relieved of mechanical stresses, such as impact shocks, for example. Furthermore, functions such as the press-and-turn function, which is also referred to as the "push to turn" function, can also be realized owing to the decoupling of the mounting unit from the switch unit. The mounting unit is preferably embodied in two parts and has a lower and an upper part. The two parts can be joined to each other by means of a screw connection and between them accommodate the edge of an aperture in the glass ceramic plate. On the lower part of the mounting unit a recess or a projection can be provided which can engage with a corresponding projection or a corresponding recess on the glass ceramic plate and so provide an anti-twist protection for the mounting unit. Alternatively or in addition the anti-twist protection can also be created for example by affixing on the underside of the glass ceramic plate a sheet-metal strip into which the lower part of the mounting unit engages with the upper part of the mounting unit on account of the connecting force or is pressed into the latter. In addition to its pure retaining function on the glass ceramic plate, the mounting device also serves to seal the inner region of the stovetop against the exterior.

The knob axis or, or as the case may be, rotary shaft of the rotary knob is preferably integrated in the mounting unit. Said rotational axis can engage in a corresponding cutout of the switch unit and in particular with the signal generation unit.

BRIEF DESCRIPTION OF THE DRAWINGS

The invention is explained again with reference to the accompanying figures, in which.

DETAILED DESCRIPTION OF THE PRESENT INVENTION

Figure 2:
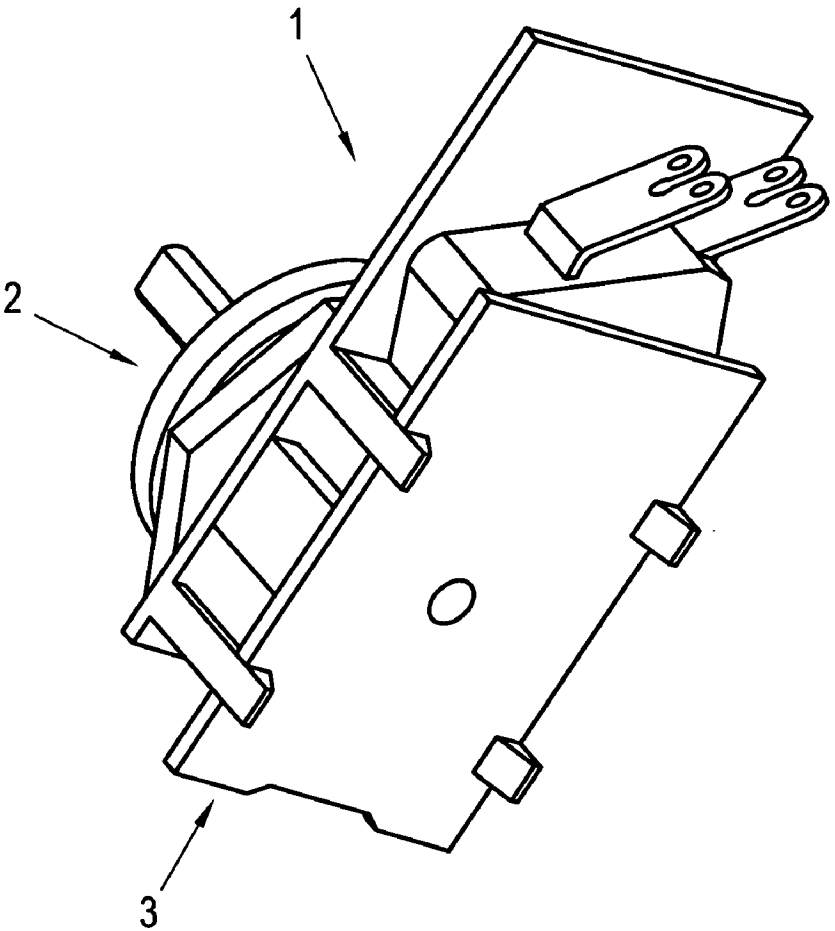
FIG. 2: shows a perspective bottom view of the embodiment of the rotary switch according to FIG. 1.
Figure 1:
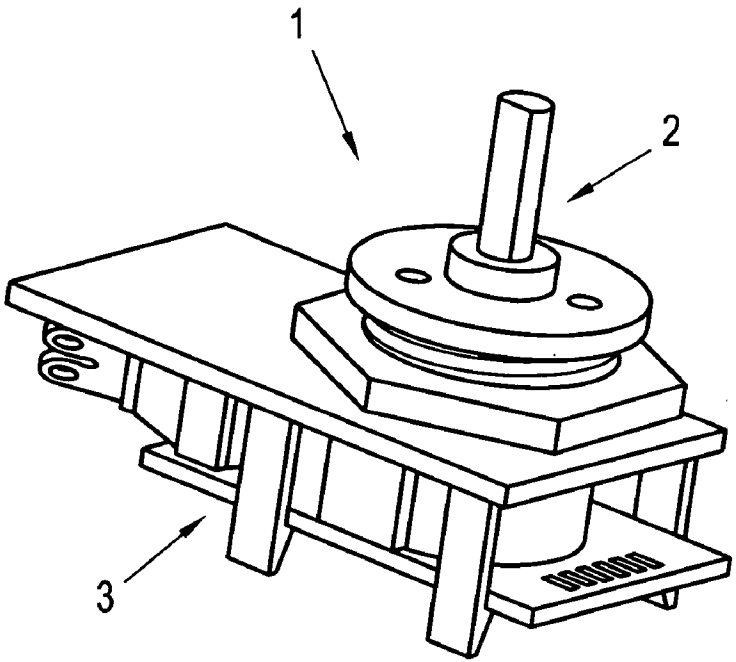
FIG. 1: shows a perspective top view of an embodiment of the rotary switch according to the invention.

FIG. 1 shows a perspective view of the rotary switch 1 according to the invention in the uninstalled state. The rotary switch 1 consists of a mounting unit 2 and a switch unit 3. To make the individual components more easily recognizable, a rotary knob that is to be mounted on the mounting unit 2 is not shown.

Figure 4:
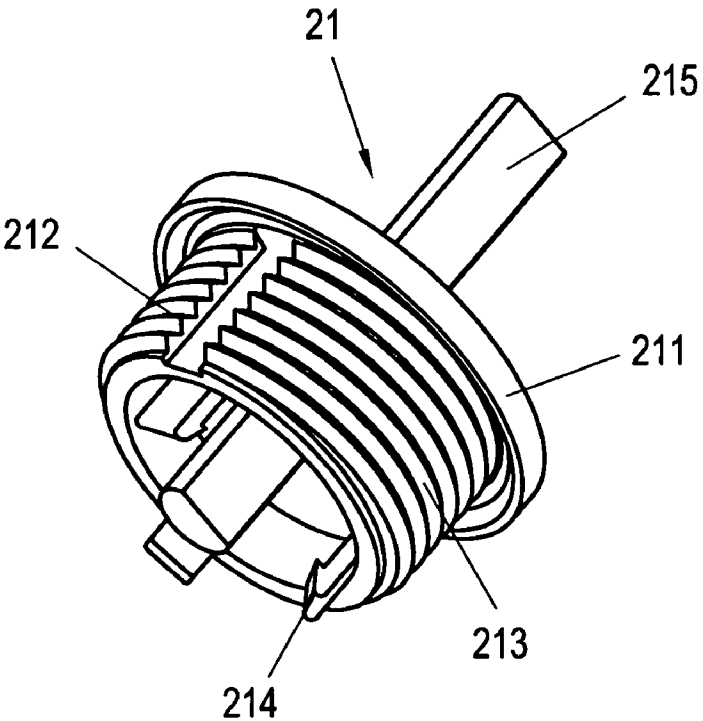
FIG. 4: shows a perspective bottom view of the upper part of the mounting unit according to FIG. 3.
Figure 3:
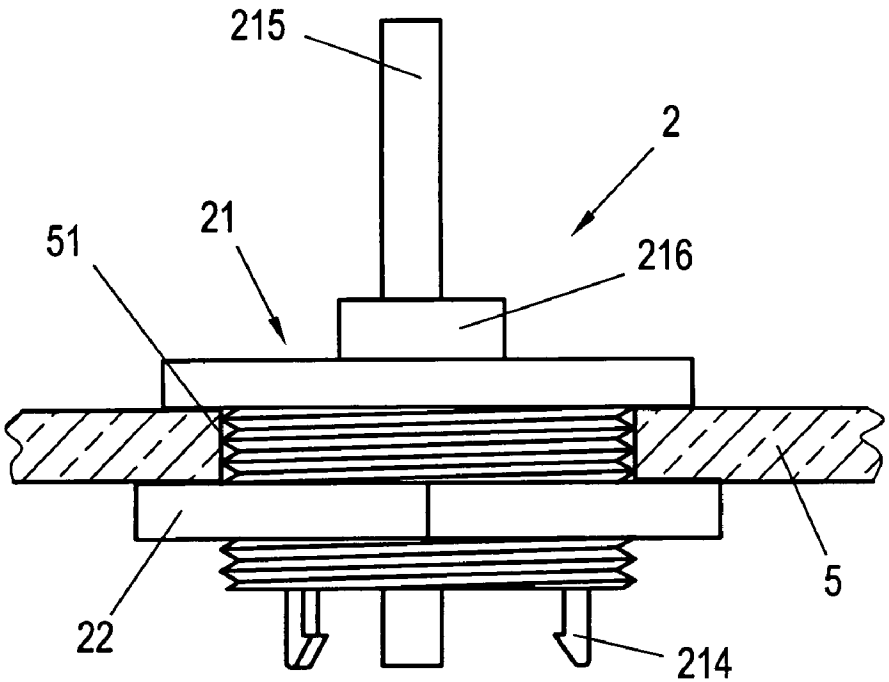
FIG. 3: shows a schematic side view of the mounting unit of an embodiment of the rotary switch according to the invention.

The mounting unit 2 consists, as can be seen from FIG. 3, of an upper part 21 and a lower part 22. The lower part 22 consists of a ring which has a hexagonal exterior and a thread on the inside. By this means the ring can be screwed to the upper part 21. The upper part 21, which is shown in more detail in FIG. 4, has a retaining ring 211, as well as a threaded part 212 connecting to the retaining ring 211. The glass ceramic plate 5 of the glass ceramic cooktop is accommodated between the retaining ring 211 and the lower part 22. An aperture 51 is provided in the glass ceramic plate 5 for that purpose. The aperture 51 has a diameter corresponding to the outer diameter of the threaded part 212. The threaded part 212 is a hollow cylinder on the outside of which a thread 213 is incorporated. Provided on the bottom edge of the threaded part 212 are latching hooks 214 which extend downward in the axial direction of the threaded part 212 and beyond the latter. A knob axis or rotary shaft 215 runs in the inside of the threaded part 212. Said rotary shaft 215 projects over the top of the retaining ring 211 and beyond the bottom edge of the threaded part 212. In the embodiment shown, the end of the rotary shaft 215 projecting over the bottom edge of the threaded part 212 corresponds to the end of the latching hooks 214 projecting over the bottom edge of the threaded part 212.

The rotary shaft 215 is held in a bearing 216 (see FIG. 3) in the upper part 21 of the mounting unit 2. The rotary shaft 215 can be rotated in the upper part 21 via said bearing 216 and preferably also displaced axially. As can be seen from FIG. 4, the rotary shaft 215 is in the shape of a rod, the latter having an essentially round cross-section. The round cross-section is flat on one side, however. This shape of the rotary shaft 215 enables a rotary force to be exerted by means of a rotary knob onto the rotary shaft 215 and in addition permits the rotary force to be easily transmitted to other components.

The switch unit 3 also provided in the rotary switch 1 has an essentially box shape. The top of the switch unit 3 is formed by a plate-shaped cover 31 (see FIG. 5). Latching cutouts 311 for receiving the latching hooks 214 of the mounting unit 2 are provided in the cover 31. Also provided in the cover 31 is an opening 312 to allow the rotary shaft 215 to pass through. The opening 312 has a circular cross-section with a diameter that is at least equivalent to the diameter of the rotary shaft 215. Thus, the opening 312 permits the rotary shaft 215 to be rotated about its axis. Running downward from the edge of the cover 31 are arms 313 via which a board 32 is joined to the cover 31. Also provided on the cover 31 are spacers 314 which hold the board 32 at a predetermined distance from the cover 31. Disposed in the switch unit 3 between the cover 31 and the board 32 are a signal generation unit 33 and a switch 34. The signal generation unit 33 and the switch 34 are arranged adjacent to each other on the board 32. In this case the signal generation unit 33 is provided underneath the opening 312 for the passage of the rotary shaft 215.

Since the end of the rotary shaft 215 projecting beyond the underside of the threaded part 212 corresponds to the projecting end of the latching hooks 214, when the latching hooks 214 are introduced into the latching cutouts 311, the rotary shaft 215 does not protrude or protrudes only slightly into the opening 312 of the cover 31 and into the signal recording unit 33 disposed thereunder. Only when the rotary shaft 215 is pressed downward via the rotary knob, i.e. in the direction of the signal generation unit 33, does the rotary shaft 215 come into engagement with the signal recording unit 33. A lock (not shown) can be provided in the mounting unit 2. This enables the so-called "push to turn" function to be realized, with which an actuation of the rotary switch 1 is only possible if the rotary knob is moved by at least a certain amount in the direction of the glass ceramic plate 5, i.e. has been depressed. The switch unit 3 is also reliably protected by the separately provided mounting unit 2 against mechanical stresses which occur, for example, in the event of lateral impact shocks against the rotary knob.

The switch 34, which represents in particular a microswitch, is disposed between the cover 31 and the board 32 in such a way that the terminals 341 and 342 are disposed facing away from the signal generation unit 33 and project beyond the board 32. This enables the switch 34 to be connected in a simple manner.

Figure 6:
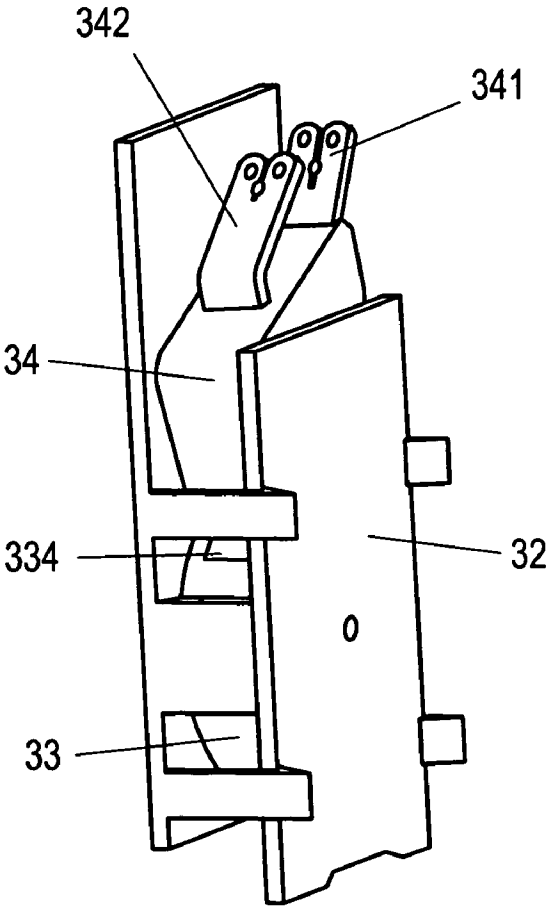
FIG. 6: shows a perspective side view of the switch unit of the rotary switch according to FIG. 1.
Figure 5:
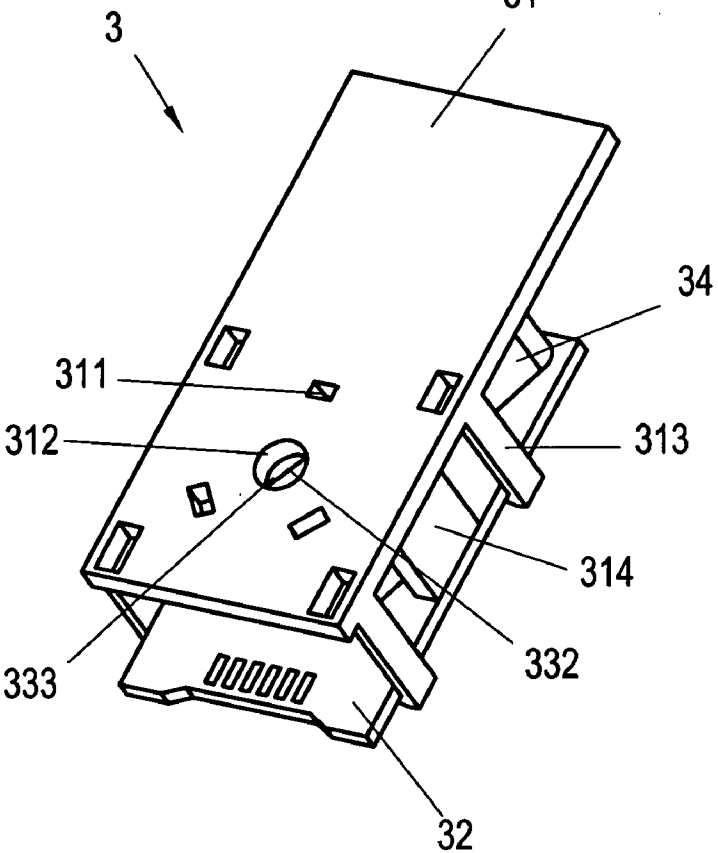
FIG. 5: shows a perspective top view onto the switch unit of the rotary switch according to FIG. 1.

Only the circular housing 331 of the signal generation unit 33 can be seen in FIG. 6. A rotary disk 332, which is just discernible through the opening 312 in FIG. 5, is preferably provided in the housing 331. Provided in the rotary disk 332 is an engagement opening 333 through which the rotary shaft 215 can engage with the signal generation unit 33 and in particular with the rotary disk 332. The engagement opening 333 has a shape which corresponds to the shape of the cross-section of the rotary shaft 215. On the side facing the switch 34 the housing 331 of the signal generation unit 33 has a recess 334.

Figure 7:
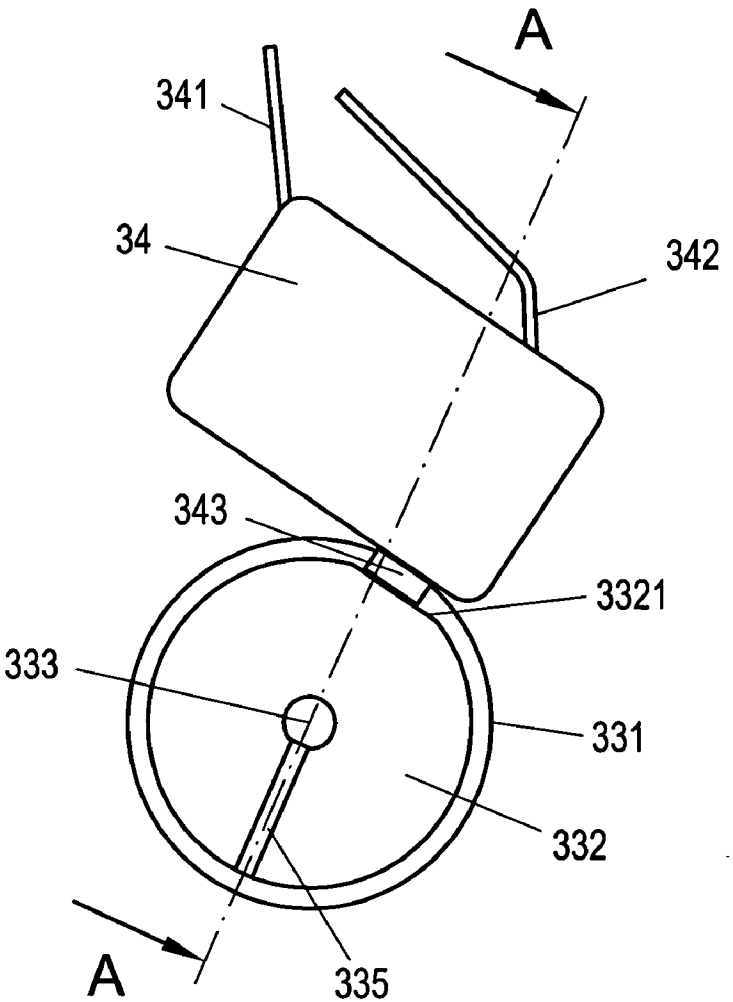
FIG. 7: shows a schematic view of the arrangement of the signal generation unit and the switch of the switch unit according to FIGS. 5 and 6.
Figure 7A:
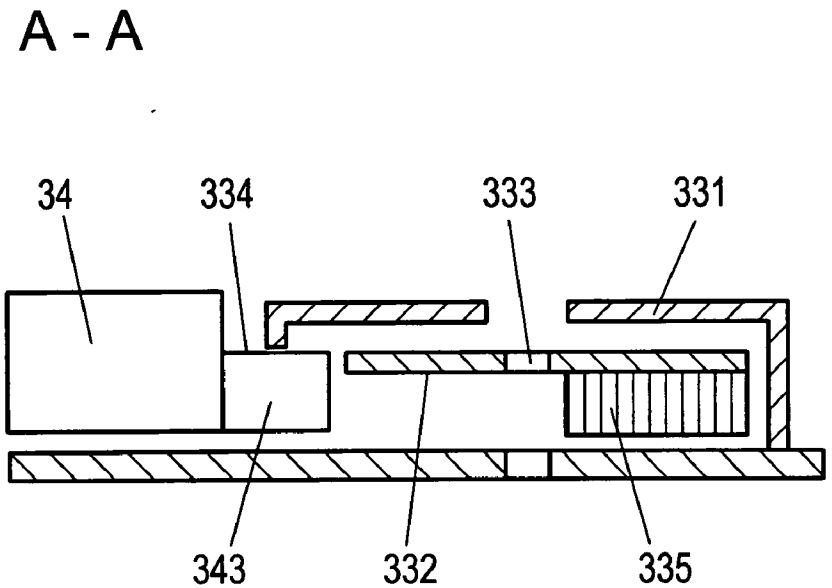
FIG. 7*a*: shows a schematic sectional view of the arrangement according to FIG. 7 along the intersection line A-A.

A possible layout of the signal generation unit 33 and its interaction with the switch 34 are indicated schematically in FIGS. 7 and 7*a*. The actuation side of the microswitch 34, which represents a pushbutton 343 in the embodiment shown, faces the signal generation unit 33.

With the actuation side and in particular with the pushbutton 343, the switch 34 engages via the recess 334 with the housing 331 of the signal generation unit 33. In the signal generation unit 33, the rotary disk 332 in the embodiment shown has an essentially circular shape with a flat section 3321. In the view shown, the rotary disk 332 is in a position in which the flat section 3321 faces toward the pushbutton 343. In this position the switch 34 is consequently not activated. If the switch 34 represents a normally open contact, an electric circuit routed through the switch 34 is therefore interrupted in this position.

If the rotary knob is turned, the rotary disk 332 rotates correspondingly owing to the engagement of the rotary shaft 215 in the engagement opening 333 of the rotary disk 332. As a result, in the embodiment shown in FIG. 7, the pushbutton 343 of the switch 34 comes into contact with the rotary disk 332 and the electric circuit that is routed through the switch 34 is closed.

Also indicated in FIG. 7 is a contact comb 335 which is mounted on the underside of the rotary disk 332 and rubs against the board 32. As a result of the rubbing of the contact comb 335, a signal can be generated which corresponds to the respective absolute angular position of the rotary disk 332. Since the rotary disk 332 is connected to the rotary knob via the rotary shaft 215, the generated signal thus reflects the angular position of the rotary knob. The signal generated in this way can be forwarded via the board 32 and made available to other components for further processing.

Figure 8:
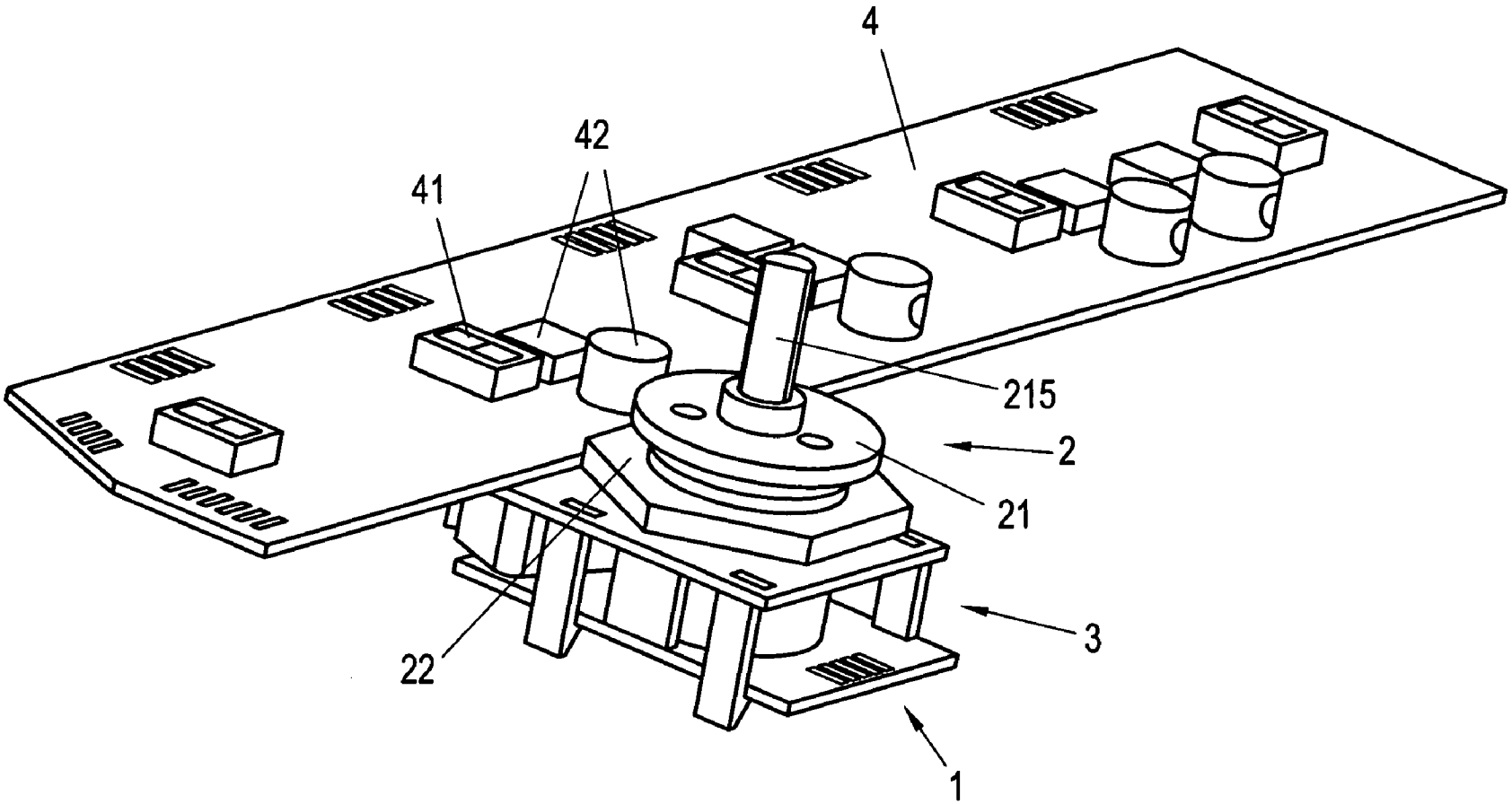
FIG. 8: shows a perspective top view onto an embodiment of the rotary switch according to the invention with a display board.
Figure 9:
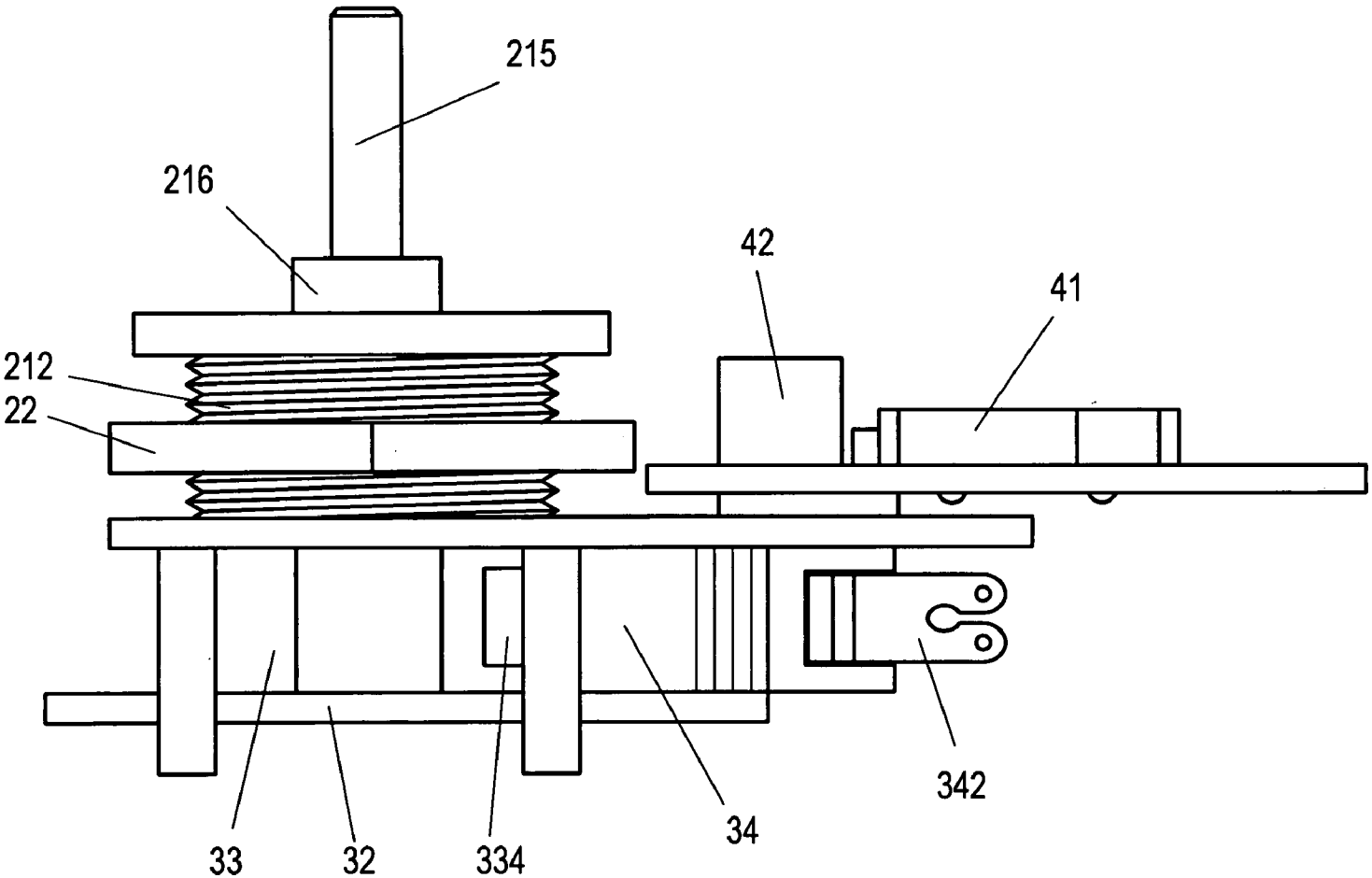
FIG. 9: shows a schematic side view of the arrangement according to FIG. 8.

A possible application is shown in FIGS. 8 and 9. In this arrangement the rotary switch 1 according to the invention is disposed on a display board 4. Arranged on the display board 4 are display elements 41 which represent in particular seven-segment displays. Also provided on the display board 4 are terminals 42 via which the display board 4 can be contacted. In the embodiment shown, the display board 4 is placed on the cover 31 of the switch unit 3 and rests with its edge against the lower part 22 of the mounting unit 2. However, the display board 4 can also be provided spaced at a distance from the switch unit 3. In particular, a mechanical contact between the switch unit 3 and the display board 4 is not necessary. The signal generated in the signal generation unit 33 can be transmitted to the display element 41 via the board 32 or, given a corresponding alignment of the signal generation unit 33, also via the cover 31. The signals generated by the signal generation unit 33 in respect of the angular position of the rotary shaft 215 can preferably be transmitted to the display board 4 via a signal cable (not shown).

This illustrated arrangement can be installed in a glass ceramic stovetop. In this case the glass ceramic plate is accommodated between the upper part 21 and the lower part 22 of the mounting unit 2. In this way both the switch unit 3 and the display board 4 are disposed in a protected location underneath the glass ceramic plate.

In an arrangement of this kind, if a rotary knob connected to the rotary shaft 215 is turned from a zero position by a user wanting to actuate the stovetop, this rotation is transmitted via the rotary shaft 215 to the signal generation unit 33, in particular to the rotary disk 332 of the signal generation unit 33. The edge of the rotary disk 332, which in the zero position was aligned with the flat section 3321 toward the pushbutton 343 of the switch 34, now stands, in the rotated position, with a part of the round circumference in contact with the pushbutton 343 of the switch 34 and actuates the switch 34.

If the switch 34 is embodied as a normally open contact, the voltage required to operate the hotplate can be made available in this state. At the same time the rotation of the rotary disk 332 effected by the turning of the rotary knob is transmitted via the contact comb 335 to the board 32 in such a way that a voltage signal is recorded there which is routed to further units. Preferably the signal recording unit 33 represents a Gray-code switch. The signal thus generated can be transmitted to the display unit 41, via which the operating stage corresponding to the current angular position of the rotary shaft 215 can be displayed.

Furthermore the signal generated by the signal generation unit 33 can also be transmitted to other units, such as, for example, a controller which regulates the heating output of the hotplate for the selected power stage.

The invention is not restricted to the embodiments shown in the figures.

Thus, for example, instead of the flat section on the rotary disk as shown, one or more other mechanical resistances can be provided via which other positions of the switch apart from the pure On and Off position can also be achieved if necessary. For example, projections can be provided at defined intervals around the circumference of the rotary disk, each of which leads to the switch component being switched to a different switch stage. The pushbutton on the switch shown in the figures is also not obligatory. Alternatively, contacts can be provided on the side of the switch facing the signal generation unit. In this case contacts are preferably also provided distributed around the circumference of the rotary disk of the signal recording unit. As soon as the contacts of the rotary disk come into contact with the contact of the switch, this can effect the desired switch position.

The embodiment of the signal recording unit with a contact comb can also be replaced according to the invention by an embodiment in which the generation of the signal can be achieved by, for example, optical, capacitive or other means.

By means of the present invention it is possible to combine a mechanical switch knob with electrical displays and/or electronic functions on glass ceramic cooktops. This is achieved in that as a result of turning the rotary knob a power switch or other switch component is simultaneously actuated and information regarding the angular position is picked up as an electrically processible signal. This has the advantage that the ease of operation of a knob-controlled stovetop, in particular owing to the size of the rotary knob and a haptic feedback, can be combined with the convenience of an electronic controller. This means that features of the stovetop, such as, for example, a timer function or other electronic functions that are controlled via the signal generation unit, are possible that are not possible using a pure knob-controlled cooktop with energy controller. Moreover, the individual rotary switches can be positioned virtually freely, thereby enabling cooktops to be equipped with up to e.g. six heating elements. By using the additional electrical switch component, in particular the power switch, it is possible to save on expensive main switch relays on the electronics board of the glass ceramic cooktop. Finally, as a result of the decoupling of the mechanical mounting unit and the switch unit, the switch components are relieved of impact shocks and other mechanical stresses. Assembly and wiring are also made easier by the decoupling of mounting unit and switch unit. Furthermore, a significant advantage of the present invention lies in the low installation height of the switch. This allows the rotary switches to be used also with glass ceramic cooktops in spite of the constricted installation situation that obtains there.

The invention claimed is:

1. A rotary switch for a glass ceramic cooktop, which rotary switch comprises:

a rotary knob projecting above a glass ceramic plate;

a switch unit on an underside of the glass ceramic cooktop interacting with said rotary knob via a knob axis, the switch unit includes a signal generator that generates an electrically processible information signal that indicates an angular position of the knob axis for control of the cooktop, wherein the signal is suitable as input for control of the cooktop, and as input for at least one additional function of the cooktop, other than said control of the cooktop.

2. The rotary switch of claim 1, wherein the switch unit includes a power switch which is actuated by the signal generator.

3. The rotary switch of claim 2, wherein the power switch is actuated via mechanical or electrical contacts on the signal generator.

4. The rotary switch of claim 2, wherein the signal generator and the power switch are adjacent to each other.

5. The rotary switch of claim 1, wherein the signal generator generates a voltage signal that indicates an angular position of the knob axis.

6. The rotary switch of claim 1, wherein the signal generator has a rotary disk.

7. The rotary switch of claim 6, comprising a switch element for switching a power switch on the circumference of the rotary disk.

8. The rotary switch of claim 1, wherein the switch unit is connected to a display unit.

9. The rotary switch of claim 1, wherein the switch unit is connected to the rotary knob via a mounting unit removably connected to the switch unit.

10. A rotary switch for a glass ceramic cooktop, which rotary switch comprises:

a rotary knob projecting above a glass ceramic plate;

a switch unit on an underside of the glass ceramic cooktop interacting with said rotary knob via a knob axis, the switch unit being mechanically coupled to the rotary knob, the switch unit includes an electronic signal generator to generate an electronically processible signal that is indicative of an angular position of the knob axis, wherein the signal is suitable as input for control of the cooktop, and as input for at least one additional function of the cooktop, other than said control of the cooktop.

11. The rotary switch of claim 10, wherein the switch unit includes a power switch which is actuatable by the signal generator.

12. The rotary switch of claim 11, wherein the power switch is actuatable via one or more mechanical or electrical contacts on the signal generator.

13. The rotary switch of claim 11, wherein the signal generator and the power switch are adjacent to each other, in a common lateral plane.

14. The rotary switch of claim 10, wherein the signal generator is configured to generate a voltage signal that indicates an angular position of the knob axis.

15. The rotary switch of claim 10, wherein the signal generator has a rotary disk.

16. The rotary switch of claim 15, further comprising a switch element to switch a power switch on the circumference of the rotary disk.

17. The rotary switch of claim 10, wherein the switch unit is connected to a display unit.

18. The rotary switch of claim 10, wherein the switch unit is connected to the rotary knob via a mounting unit removably connected to the switch unit.

19. The rotary switch of claim 10, further comprising an electronics board provided to the switch unit, the signal generator including structure to directly contact a portion of the electronics board to generate said electronically processible signal.

20. The rotary switch of claim 19, further comprising a display board including at least one display element, wherein the signal can be transmitted from the electronics board to the display board.

21. The rotary switch of claim 19, wherein the switch unit includes a power switch, and wherein the electronics board does not include a relay for the power switch.

22. The rotary switch of claim 10, wherein the electronically processible signal is available to one or more other components for further processing.

23. A cooktop assembly comprising:

the glass ceramic cooktop; and the rotary switch of claim 10.

24. The cooktop assembly of claim 23, wherein the glass ceramic top includes a throughhole through which a rotary shaft extends along said knob axis.

25. The cooktop assembly of claim 24, wherein the shaft is configured to directly contact a surface of the signal generator.

* * * * *